US007021741B2

(12) United States Patent
Aldrich et al.

(10) Patent No.: US 7,021,741 B2
(45) Date of Patent: Apr. 4, 2006

(54) PRINTHEAD CAP ASSEMBLY FOR AN INK JET PRINTER

(75) Inventors: Charles Stanley Aldrich, Nicholasville, KY (US); Jeffrey Ray Ehlert, Lexington, KY (US); Martin Alan Johnson, Winchester, KY (US); Daniel Robert LaBar, Lexington, KY (US); Robert Michael Meadows, Lexington, KY (US); Brian Andrew Naro, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 223 days.

(21) Appl. No.: 10/718,727

(22) Filed: Nov. 21, 2003

(65) Prior Publication Data

US 2005/0110827 A1 May 26, 2005

(51) Int. Cl.
*B41J 2/165* (2006.01)

(52) U.S. Cl. ..... 347/29; 347/32; 347/33; 347/30

(58) Field of Classification Search ..... 347/22–35
See application file for complete search history.

(56) References Cited

U.S. PATENT DOCUMENTS

| | | | | |
|---|---|---|---|---|
| 4,684,963 | A | 8/1987 | Naka | |
| 5,517,220 | A | 5/1996 | English | |
| 5,534,896 | A | 7/1996 | Osborne | |
| 5,563,637 | A | 10/1996 | Francis et al. | |
| 5,619,232 | A | 4/1997 | Maeno | |
| 5,661,510 | A | 8/1997 | Brandon et al. | |
| 5,751,324 | A | 5/1998 | Brandon et al. | |
| 5,867,184 | A | 2/1999 | Quintana | |
| 5,867,187 | A | 2/1999 | Toniolo | |
| 5,956,053 | A * | 9/1999 | Michael | 347/29 |
| 6,042,216 | A | 3/2000 | Garcia et al. | |
| 6,135,585 | A | 10/2000 | Johnson et al. | |
| 6,139,129 | A | 10/2000 | Tabasso et al. | |
| 6,209,983 | B1 | 4/2001 | Osborne et al. | |
| 6,220,689 | B1 | 4/2001 | Sturgeon | |
| 6,241,336 | B1 | 6/2001 | Muraki | |
| 6,273,562 | B1 | 8/2001 | Deshmukh | |
| 6,283,576 | B1 * | 9/2001 | Premnath et al. | 347/29 |
| 6,398,338 | B1 | 6/2002 | Berg et al. | |
| 6,398,339 | B1 | 6/2002 | Berg | |
| 6,402,293 | B1 | 6/2002 | Sawicki | |
| 6,481,826 | B1 | 11/2002 | Hara et al. | |
| 6,517,185 | B1 | 2/2003 | Aldrich | |
| 6,533,388 | B1 | 3/2003 | Toh et al. | |
| 6,547,368 | B1 | 4/2003 | Silverbrook | |
| 6,565,189 | B1 | 5/2003 | Yamada et al. | |
| 6,578,949 | B1 | 6/2003 | Takahashi et al. | |
| 6,616,265 | B1 | 9/2003 | Shindo et al. | |

* cited by examiner

*Primary Examiner*—Shih-wen Hsieh
(74) *Attorney, Agent, or Firm*—Elizabeth C. Jacobs, Esq.; Ronald K. Aust, Esq.

(57) ABSTRACT

A printhead capping assembly includes a cap holder and a printhead cap. The cap holder defines a cavity and a vent exit. The printhead cap has a base and a lip portion extending from the base. The lip portion defines an open interior region. The base is inserted into the cavity of the cap holder. The base includes a serpentine channel extending from the open interior region to the vent exit of the cap holder.

23 Claims, 4 Drawing Sheets

PRINTHEAD CAP ASSEMBLY FOR AN INK JET PRINTER

BACKGROUND OF THE INVENTION

1. Field of the Invention

The present invention relates to printhead maintenance in an ink jet printer, and, more particularly, to a printhead capping assembly.

2. Description of the Related Art

Ink jet printers form an image on a print medium by selectively ejecting ink from one or more of a plurality of ink jet nozzles formed in a nozzle plate of an ink jet printhead. In order to maintain the printhead at an acceptable level of performance, ink jet printers typically include a maintenance station for performing scheduled maintenance operations and for providing a sealed environment for the printhead nozzle plate during periods of non-use.

One example of a maintenance station includes a movable maintenance sled including a printhead wiper and a printhead cap. The printhead wiper includes a blade edge for engaging the printhead nozzle plate to remove waste ink and contaminants that have accumulated on the printhead nozzle plate during printing. The printhead cap is moved by the maintenance sled from a non-contact position with respect to the printhead to a contact position with respect to the printhead in an attempt to provide a sealed environment around the ink jet nozzles of the printhead.

Typically, the cap is formed as a generally rectangular structure defined by four adjoining walls that extend vertically upwardly from a base, and is made from an elastomer, with an upper portion of the four adjoining walls defining a single sealing lip. Commonly, the elastomer cap is placed over the nozzle plate of the printhead in an attempt to provide a sufficiently humid environment to avoid undesirable drying and crystallization of ink on the printhead that may plug ink jet nozzles. Such a cap attempts to form an effective seal between the printhead nozzles and the ambient environment. However, where such an effective seal is formed, such a system may not provide adequate water containment evaporation.

What is needed in the art is a printhead capping assembly designed to maintain an effective seal around the printhead nozzle plate while providing adequate water containment evaporation at a desired evaporation loss rate.

SUMMARY OF THE INVENTION

The present invention provides a printhead capping assembly designed to maintain an effective seal around the printhead nozzle plate while providing adequate water containment evaporation at a desired evaporation loss rate with an adequate vent capacity.

The invention, in one form thereof, is directed to printhead capping assembly. The printhead capping assembly includes a cap holder and a printhead cap. The cap holder defines a cavity and a vent exit. The printhead cap has a base and a lip portion extending from the base. The lip portion defines an open interior region. The base is inserted into the cavity of the cap holder. The base includes a serpentine channel extending from the open interior region to the vent exit of the cap holder.

The invention, in another form thereof, is directed to a printhead cap including a base and a lip portion extending from the base. The lip portion defines an open interior region. The printhead cap has a vent hole in fluidic communication with the open interior region. The base includes a serpentine channel extending from the vent hole and around the base.

The invention, in still another form thereof, is directed to an ink jet printer. The ink jet printer includes a printhead and a printhead capping assembly to facilitate a capping of the printhead. The printhead capping assembly includes a cap holder and a printhead cap. The cap holder defines a cavity and a vent exit. A printhead cap has a base and a lip portion extending from the base. The lip portion defines an open interior region. The base is inserted into the cavity of the cap holder. The base includes a serpentine channel extending from the open interior region to the vent exit of the cap holder.

An advantage of the invention is the ability to establish water containment evaporation with respect to a capped printhead at a desired evaporation loss rate by selection of an appropriate vent path length to width and/or depth ratio.

Another advantage of the invention is the ability to establish an appropriate vent path length in a relatively small area.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
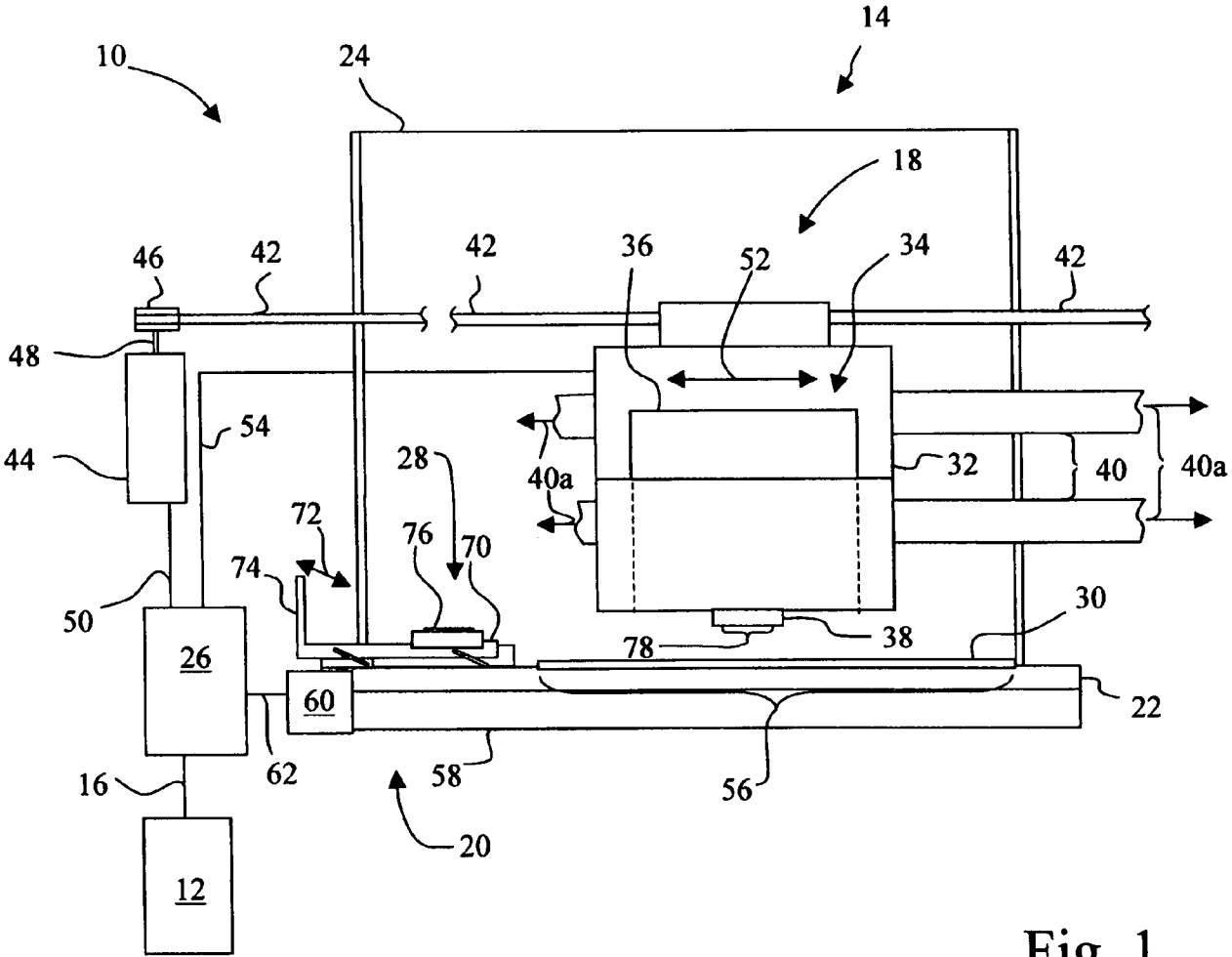
FIG. 1 is a diagrammatic representation of an imaging system employing an embodiment of the present invention.

Referring now to the drawings and more particularly to FIG. 1, there is shown an imaging system 10 employing an embodiment of the present invention. Imaging system 10 includes a computer 12 and an imaging apparatus in the form of an ink jet printer 14. Ink jet printer 14 may, for example, be used as the print engine in a multifunction device, such as a device that also includes faxing and copying capabilities. Computer 12 is communicatively coupled to ink jet printer 14 by way of communications link 16. Communications link 16 may be, for example, a wired connection, an optical connection, such as an optical or r.f. connection, or a network connection, such as an Ethernet Local Area Network.

Computer 12 is typical of that known in the art, and includes a monitor to display graphics or text, an input device such as a keyboard and/or mouse, a microprocessor and associated memory, such as random access memory (RAM), read only memory (ROM) and a mass storage device, such as CD-ROM or DVD hardware. Resident in the memory of computer 12 is printer driver software. The printer driver software places print data and print commands in a format that can be recognized by ink jet printer 14.

Ink jet printer 14 includes a printhead carrier system 18, a feed roller unit 20, a mid-frame 22, a media source 24, a controller 26 and a maintenance station 28.

Media source 24 is configured and arranged to supply from a stack of print media a sheet of print media 30 to feed roller unit 20, which in turn further transports the sheet of print media 30 during a printing operation.

Printhead carrier system 18 includes a printhead carrier 32 for carrying one or more printhead cartridges, such as a color printhead cartridge and/or monochrome printhead cartridge, which is mounted thereto. For convenience and ease of understanding the invention, a single printhead cartridge 34 is shown. Printhead cartridge 34 includes an ink reservoir 36 provided in fluid communication with an ink jet printhead 38.

Printhead carrier 32 is guided, for example, by a pair of guide rods 40. The axes 40*a* of guide rods 40 define a bi-directional scanning path 52 of printhead carrier 32. Printhead carrier 32 is connected to a carrier transport belt 42 that is driven by a carrier motor 44 via a carrier pulley 46. Carrier motor 44 can be, for example, a direct current motor or a stepper motor. Carrier motor 44 has a rotating motor shaft 48 that is attached to carrier pulley 46. Carrier motor 44 is electrically connected to controller 26 via a communications link 50. At a directive of controller 26, printhead carrier 32 is transported, via the rotation of carrier pulley 46 imparted by carrier motor 44, in a reciprocating manner, back and forth along guide rods 40.

Ink jet printhead 38 is electrically connected to controller 26 via a communications link 54. Controller 26 supplies electrical address and control signals to ink jet printer 14, and in particular, to the ink jetting actuators of ink jet printhead 38, to effect the selective ejection of ink from ink jet printhead 38.

During a printing operation, the reciprocation of printhead carrier 32 transports ink jet printhead 38 across the sheet of print media 30 along bi-directional scanning path 52, i.e. a scanning direction, to define a print zone 56 of ink jet printer 14. Bi-directional scanning path 52, also referred to as scanning direction 52, is parallel with axes 40*a* of guide rods 40, and is also commonly known as the horizontal direction. During each scan of printhead carrier 32, the sheet of print media 30 is held stationary by feed roller unit 20. Feed roller unit 20 includes a feed roller 58 and a drive unit 60. The sheet of print media 30 is transported through print zone 56 by the rotation of feed roller 58 of feed roller unit 20. A rotation of feed roller 58 is effected by drive unit 60. Drive unit 60 is electrically connected to controller 26 via a communications link 62.

Maintenance station 28 is provided for performing printhead maintenance operations on the ink jet nozzles of ink jet printhead 38. Such operations include, for example, a printhead spit maintenance operation, a printhead wiping operation and a printhead maintenance capping operation. Other services, such as for example, printhead priming and suction, may also be performed if desired by the inclusion of a vacuum device (not shown) of a type well known in the art.

Maintenance station 28 includes a movable maintenance sled 70, of a type which is well known in the art, that is configured for movement in the directions generally depicted by double-headed arrow 72. The directions generally depicted by double-headed arrow 72 include both horizontal and vertical components. Maintenance sled 70 includes a carrier engagement member 74. Maintenance sled 70 is biased by a spring (not shown) in a direction toward printhead carrier 32. Mounted to maintenance sled 70 is a printhead capping assembly 76 of the present invention.

With the orientation of components as shown in FIG. 1, a leftward movement of printhead carrier 32 causes printhead carrier 32 to engage carrier engagement member 74, thereby causing maintenance sled 70 to move to the left and upward, as illustrated by arrow 72, thereby raising printhead capping assembly 76 toward a capping elevation with respect to ink jet printhead 38. When printhead capping assembly 76 reaches the capping elevation, printhead capping assembly 76 will have fully engaged ink jet printhead 38 of printhead cartridge 34, thereby providing a seal in a region 78 containing an ink jet nozzle plate and its associated ink jet nozzles.

While in the embodiment described herein printhead capping assembly 76 is used on a maintenance sled type of printhead maintenance system, those skilled in the art will recognize that printhead capping assembly 76, as described in more detail below, may be incorporated into other types of printhead maintenance systems, such as for example, a rack type or rotary type maintenance system.

Figure 2:
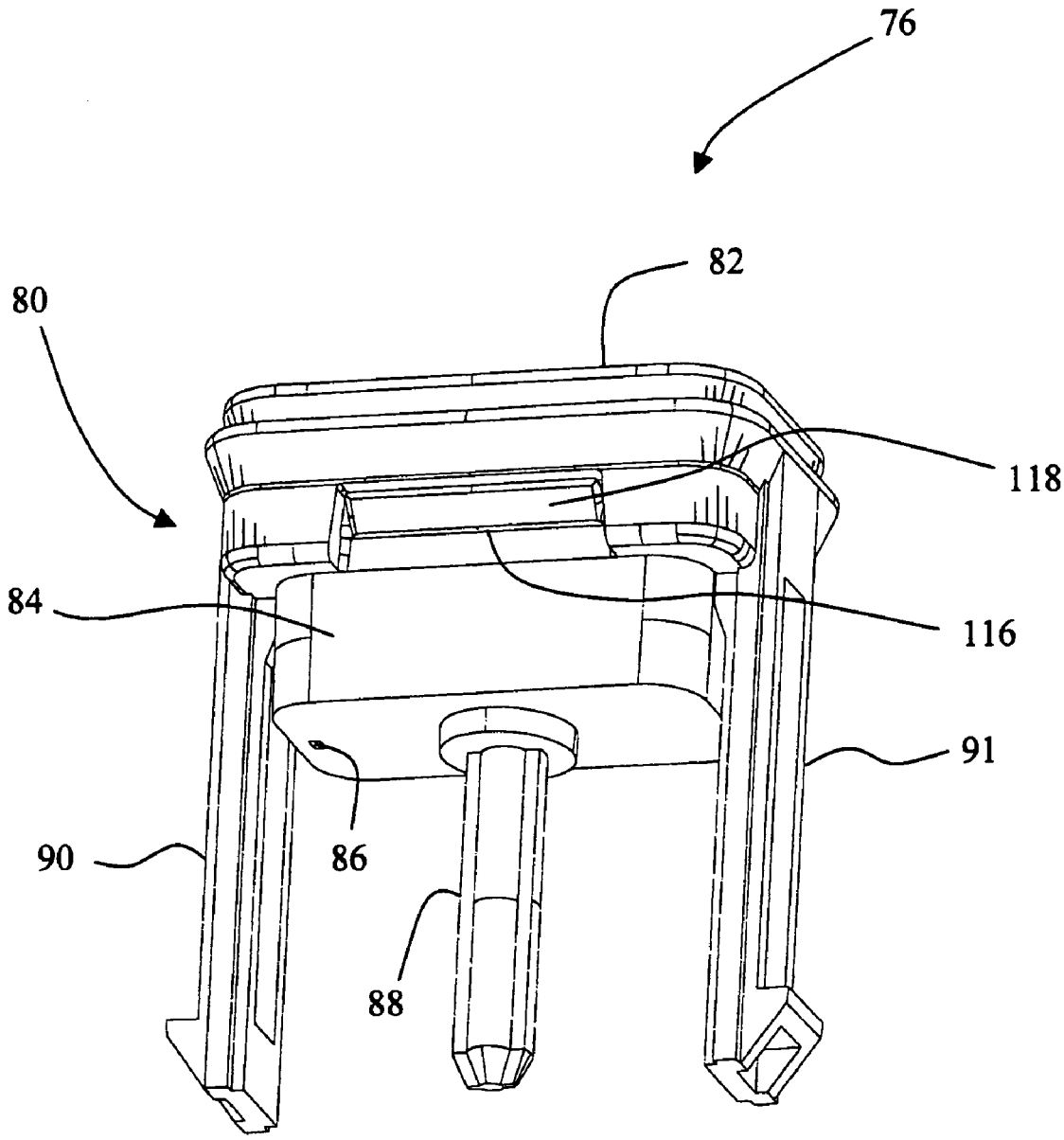
FIG. 2 is a perspective view of a printhead capping assembly in accordance with the present invention, included in the maintenance system of the ink jet printer of FIG. 1.
Figure 3:
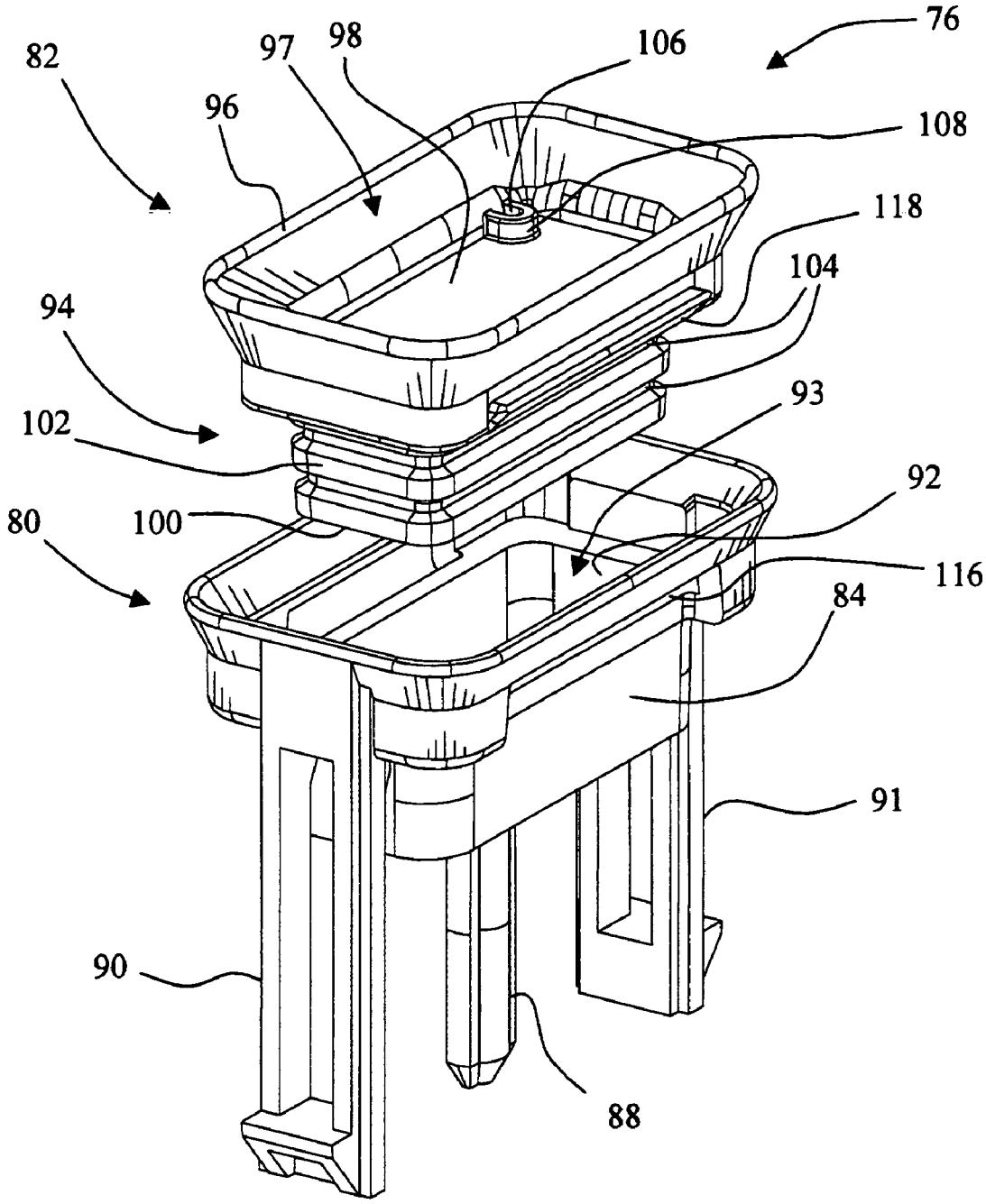
FIG. 3 is an exploded perspective view of the printhead cap and cap holder of the printhead capping assembly of FIG. 2.

Referring to FIGS. 2 and 3, printhead capping assembly 76 includes a cap holder 80 and a printhead cap 82.

Cap holder 80 includes a body 84 including a vent exit 86, an extension member 88 and two mounting posts 90, 91. Extension member 88 and mounting posts 90, 91 are used to attach printhead capping assembly 76 to a mounting fixture, such as maintenance sled 70, via a spring-loaded gimbaling mechanism (not shown). Body 84 is configured as an open housing 92 defining a cavity 93 to receive therein a portion of printhead cap 82. Vent exit 86 is located and configured to cooperate with printhead cap 82 to permit the fluidic communication of printhead cap 82 with the atmosphere when printhead cap 82 is positioned in sealing relationship with region 78 of ink jet printhead 38 (see also FIG. 1). Cap holder 80 may be formed, for example, from a plastic material.

Figure 4:
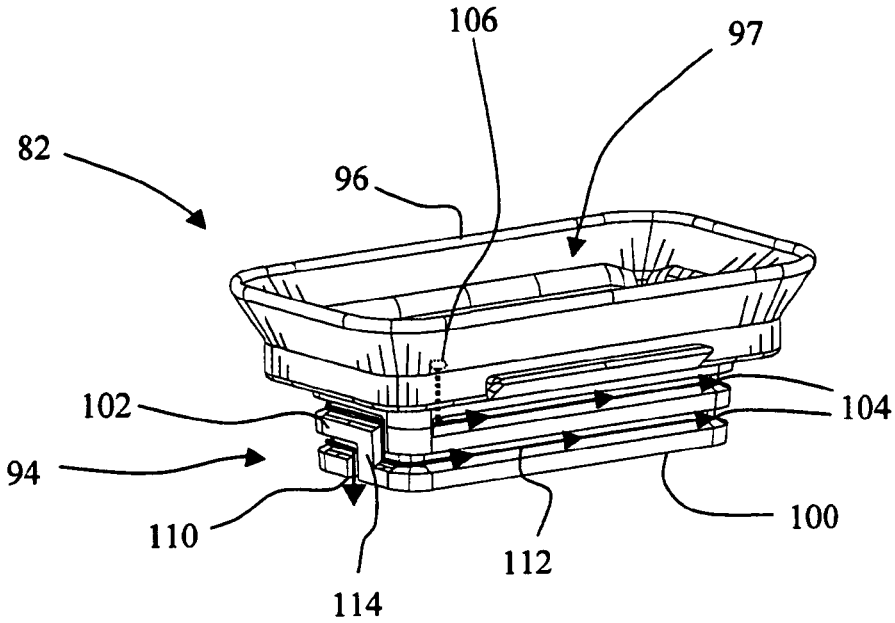
FIG. 4 is a side perspective view of the printhead cap of FIG. 3.
Figure 5:
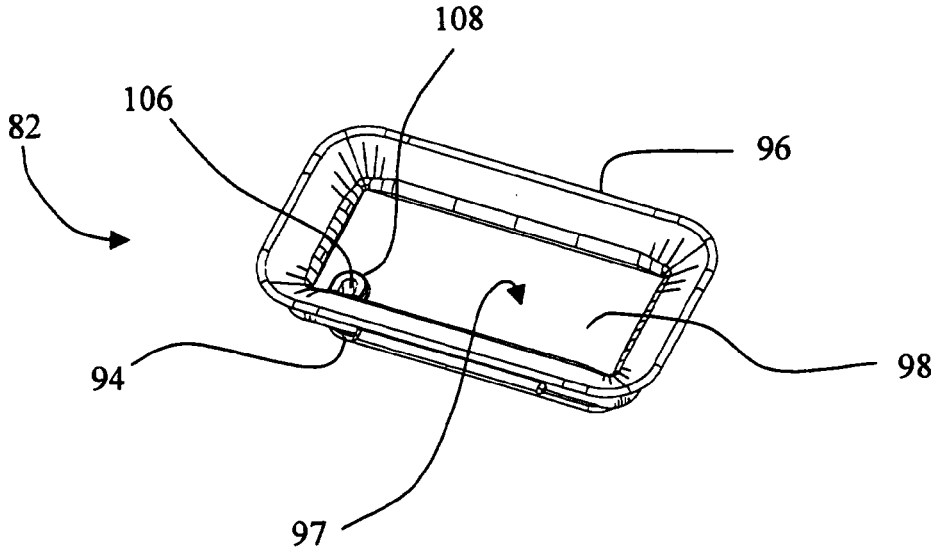
FIG. 5 is a top perspective view of the printhead cap of FIG. 3.

Referring to FIGS. 3–5, printhead cap 82 may be formed from an elastomer, such as rubber. Printhead cap 82 includes a base 94 from which a sealing lip portion 96 extends. Sealing lip portion 96 defines an open interior region 97 of printhead cap 82. Base 94 includes an upper surface 98, a lower surface 100 spaced apart from upper surface 98, and an outer sidewall portion 102 extending from lower surface 100 toward upper surface 98. The terms "upper" and "lower" are relative terms used for convenience and ease of understanding the invention with respect to the component orientations shown in FIGS. 2–5, and are not intended to limit the orientation of printhead cap 82 when installed in a printer, such as ink jet printer 14. The outer sidewall portion 102 includes a serpentine channel 104 formed in and around outer sidewall portion 102 of base 94. A vent hole 106 is formed in upper surface 98 of base 94, and is located in fluidic communication with open interior region 97 of printhead cap 82. An elevated wall 108 extends upwardly from upper surface 98 of base 94, and is located to surround vent hole 106 to prevent waste ink and/or other contaminants that have settled onto upper surface 98 from clogging vent hole 106.

Serpentine channel 104 extends from the vent hole 106 formed in upper surface 98 of base 94, and spirals around base 94 in outer sidewall portion 102 until its termination at a terminal opening 110 at lower surface 100, thereby defining a vent path 112 as depicted by the arrows shown in FIG. 4. In the embodiment shown in FIG. 4, the number of spirals around base 94 in outer sidewall portion 102 is about two.

With the design of printhead cap 82 in accordance with the present invention, serpentine channel 104 may have, for example, a length to width (or length to depth) ratio of about 120:1, wherein such a ratio of 30:1 or greater is desirable. The actual ratio may be determined based upon the amount of liquid diffusion to the atmosphere that is desired to promote a relatively low evaporation rate of fluids in printhead cap 82 when printhead cap 82 is raised into sealing engagement with ink jet printhead 38. Accordingly, the ratio may be increased, for example, by adding more length to serpentine channel 104, e.g., adding more spirals around base 94, with a corresponding change in the position of vent exit 86 and/or vent hole 106 if necessary, or by decreasing the channel width and/or depth of serpentine channel 104. Likewise, the ratio may be decreased, for example, by reducing the length of serpentine channel 104, e.g., reducing the number of spirals around base 94, with a corresponding change in the position of vent exit 86 and/or vent hole 106 if necessary, or by decreasing the channel width and/or depth of serpentine channel 104.

The cross-sectional area of serpentine channel 104 may essentially be of any desired shape, such as radial or polygonal, such as rectangular, or more specifically, square. However, those skilled in the art will recognize that the width and depth of serpentine channel 104 must be sufficient so as to maintain a fluid path through vent path 112 from vent hole 106 in printhead cap 82 to vent exit 86 in cap holder 80 when printhead cap 82 is inserted into cavity 93 of cap holder 80.

While in FIG. 2 vent exit 86 is shown as a hole, similar in size to terminal opening 110 of FIG. 3, this need not be the case, since vent exit 86 is provided to facilitate the fluidic communication of terminal opening 110 of serpentine channel 104 with the atmosphere. For example, a substantial portion of the cap holder region around vent exit 86 may be removed, without adversely affecting the operation of vent path 112.

In the embodiment shown in FIG. 4, serpentine channel 104 spirals around base 94 in a step-like manner, as defined for example by channel step 114. However, it is contemplated that, alternatively, serpentine channel 104 may spiral downwardly from vent hole 106 in other manners, such as for example, in a smooth continuous spiral, e.g., in a screw thread-like manner.

During assembly of printhead capping assembly 76, base 94 of printhead cap 82 is inserted into cavity 93 of cap holder 80, whereby terminal opening 110 of serpentine channel 104 in base 94 of printhead cap 82 is placed in fluidic communication with the vent exit 86 formed in cap holder 80. Terminal opening 110 may be, for example, spaced from vent exit 86, or alternatively, may be positioned adjacent vent exit 86. Base 94 of printhead cap 82 is sized so that outer sidewall portion 102 of printhead cap 82 engages the walls of housing 92 of cap holder 80, defining cavity 93, in an interference fit. Due to the elastomeric properties of printhead cap 82, the interference fit produces a seal between base 94 of printhead cap 82 and housing 92 of cap holder 80, thereby completing the definition of vent path 112 that follows serpentine channel 104. Thus, the design of printhead capping assembly 76 allows for easy assembly by simply pressing the base 94 of printhead cap 82 into cavity 93 of cap holder 80, while establishing a vent path, such as vent path 112, of the desired length.

Referring to FIGS. 2 and 3, cap holder 80 may include a latch slot 116, and printhead cap 82 may include a latch member 118. Latch member 118 engages latch slot 116 to hold printhead cap 82 in position so as to resist a removal force, once base 94 of printhead cap 82 is seated in housing 92 of cap holder 80.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printhead capping assembly, comprising:

a cap holder defining a cavity and a vent exit; and a printhead cap having a base and a lip portion extending from said base, said lip portion defining an open interior region, said base being inserted into said cavity of said cap holder, said base including a serpentine channel extending from said open interior region to said vent exit of said cap holder.

2. The printhead capping assembly of claim 1, said base having an outer sidewall portion, said serpentine channel being formed in said outer sidewall portion.

3. The printhead capping assembly of claim 2, wherein said serpentine channel spirals around said base of said printhead cap in said outer sidewall portion.

4. The printhead capping assembly of claim 2, wherein said serpentine channel spirals in a step-like manner around said base of said printhead cap in said outer sidewall portion.

5. The printhead capping assembly of claim 2, said base including a vent hole in fluidic communication with said open interior region, said serpentine channel defining a vent path from said vent hole at said open interior region of said printhead cap to said vent exit of said cap holder.

6. The printhead capping assembly of claim 5, said base having an upwardly extending wall surrounding said vent hole.

7. The printhead capping assembly of claim 1, wherein said serpentine channel has a length to width ratio, or a length to depth ratio, of 30:1 or larger.

8. The printhead capping assembly of claim 1, wherein said serpentine channel has a length to width ratio, or a length to depth ratio, of about 120:1.

9. A printhead cap, comprising a base and a lip portion extending from said base, said lip portion defining an open interior region, said printhead cap having a vent hole in fluidic communication with said open interior region, said base including a serpentine channel extending from said vent hole and around an exterior of said base.

10. The printhead cap of claim 9, said base having an outer sidewall portion, said serpentine channel being formed in said outer sidewall portion.

11. The printhead cap of claim 10, said base having a first surface separated from a second surface, said vent hole being located at said first surface of said base, said base having a terminal opening located at said second surface of said base, said serpentine channel defining a vent path from said vent hole of said base to said terminal opening of said base.

12. The printhead cap of claim 9, wherein said serpentine channel has a length to width ratio, or a length to depth ratio, of 30:1 or larger.

13. The printhead cap of claim 9, wherein said serpentine channel has a length to width ratio, or a length to depth ratio, of about 120:1.

14. The printhead cap of claim 9, wherein said serpentine channel spirals in a step-like manner around said base of said printhead cap in an outer sidewall portion of said base.

15. The printhead cap of claim 9, said vent hole being formed in said base, said base having an upwardly extending wall surrounding said vent hole.

16. An ink jet printer, comprising:

a printhead; and a printhead capping assembly to facilitate a capping of said printhead, said printhead capping assembly including:

a cap holder defining a cavity and a vent exit; and a printhead cap having a base and a lip portion extending from said base, said lip portion defining an open interior region, said base being inserted into said cavity of said cap holder, said base including a serpentine channel extending from said open interior region to said vent exit of said cap holder.

17. The ink jet printer of claim 16, said base having an outer sidewall portion, said serpentine channel being formed in said outer sidewall portion.

18. The ink jet printer of claim 17, wherein said serpentine channel spirals around said base of said printhead cap in said outer sidewall portion.

19. The ink jet printer of claim 17, wherein said serpentine channel spirals in a step-like manner around said base of said printhead cap in said outer sidewall portion.

20. The ink jet printer of claim 17, said base including a vent hole in fluidic communication with said open interior region, said serpentine channel defining a vent path from said vent hole at said open interior region of said printhead cap to said vent exit of said cap holder.

21. The ink jet printer of claim 17, said base having an upwardly extending wall surrounding said vent hole.

22. The ink jet printer of claim 16, wherein said serpentine channel has a length to width ratio, or a length to depth ratio, of 30:1 or larger.

23. The ink jet printer of claim 16, wherein said serpentine channel has a length to width ratio, or a length to depth ratio, of about 120:1.

* * * * *